United States Patent [19]

Hasegawa

[11] Patent Number: 4,557,677

[45] Date of Patent: Dec. 10, 1985

[54] VALVELESS LUBRICANT PUMP FOR A LATERAL ROTARY COMPRESSOR

[75] Inventor: Masumi Hasegawa, Fuji, Japan

[73] Assignee: Tokyo Shibaura Denki Kabushiki Kaisha, Kawasaki, Japan

[21] Appl. No.: 679,940

[22] Filed: Dec. 10, 1984

Related U.S. Application Data

[63] Continuation of Ser. No. 373,245, Apr. 29, 1982, abandoned.

[30] Foreign Application Priority Data

Apr. 30, 1981 [JP] Japan ..... 56-61501[U]

[51] Int. Cl.[4] ..... F04C 18/00; F04C 29/02; F04B 39/02

[52] U.S. Cl. ..... 418/63; 418/88; 418/94; 417/76; 417/368; 417/410; 417/557; 417/902; 184/6.16

[58] Field of Search ..... 418/63, 87, 88, 94; 417/76, 87, 151, 204, 240, 368, 372, 410, 557, 902; 184/6.16

[56] References Cited

U.S. PATENT DOCUMENTS

| | | | |
|---|---|---|---|
| 3,023,708 | 3/1962 | Thiele | 417/240 |
| 3,289,594 | 12/1966 | Theile | 417/557 |
| 3,746,477 | 7/1973 | Ozu et al. | 417/372 |
| 3,797,969 | 3/1974 | Weatherhead et al. | 417/273 |
| 4,352,637 | 10/1982 | Weisenbach | 417/151 |
| 4,355,963 | 10/1982 | Tanaka et al. | 417/902 |
| 4,385,875 | 5/1983 | Kanazawa | 418/88 |

FOREIGN PATENT DOCUMENTS

| | | | |
|---|---|---|---|
| 2504344 | 10/1975 | Fed. Rep. of Germany | 417/87 |
| 2343199 | 9/1977 | France | 417/151 |
| 22035 | 6/1972 | Japan | 418/88 |
| 87512 | 7/1975 | Japan | 418/88 |
| 31918 | 3/1979 | Japan | 418/88 |
| 56-34998 | 4/1981 | Japan | 418/88 |
| 2059510 | 4/1981 | United Kingdom | 417/410 |

*Primary Examiner*—William L. Freeh
*Assistant Examiner*—Paul F. Neils
*Attorney, Agent, or Firm*—Cushman, Darby & Cushman

[57] ABSTRACT

A lateral rotary compressor comprises a compressing mechanism including a blade chamber for filling the lubricating oil, and a blade contained in the blade chamber and reciprocatingly movably between the first position where the blade chamber is increased to the maximum volume and the second position where the blade chamber is decreased to the minimum volume, and a supply tube for communicating the blade chamber with bearings and having an opening formed at the position located in a lubricating oil reservoir. The blade chamber is not communicated with the lubricating oil reservoir except via the supply tube, whereby when the blade is moved to the first position, the lubricating oil in the supply tube and the lubricating oil from the reservoir through the opening formed at the supply tube are sucked into the blade chamber, and when the blade is moved to the second position, the lubricating oil in the blade chamber and the lubricating oil from the reservoir through the opening formed at the supply tube are delivered to the bearings.

8 Claims, 5 Drawing Figures

VALVELESS LUBRICANT PUMP FOR A LATERAL ROTARY COMPRESSOR

This is a continuation of application Ser. No. 373,245, filed Apr. 29, 1982 and now abandoned.

BACKGROUND OF THE INVENTION

This invention relates to a lateral rotary compressor used in assembly, for example, in an air conditioner, a refrigerator, etc., and, more particularly, to a lateral rotary compressor provided with a lubricating device for automatically feeding lubricating oil to a bearing.

The conventional lateral rotary compressor of this type has been known by Japanese Patent Disclosure 56-34998, for example. In the device an oil suction hole and an oil exhaust hole are perforated at a blade chamber for containing a blade of the compressor, and a lubricating oil feed passage for feeding lubricating oil to the bearings of the compressor is connected to the oil exhaust hole. In such a conventional compressor, the oil is sucked through the oil suction hole into the blade chamber when the blade reciprocating upon rotation of the rotary shaft moves in a direction for increasing the volume in the blade chamber, and the oil is exhausted from the oil exhaust hole in the blade chamber to the oil feed passage when the blade moves, on the other hand, in a direction for decreasing the volume of the blade chamber. In such arrangement, the lubricating oil is sucked from the oil suction hole, but since a part of the lubricating oil leaks out through the oil suction hole further innovations were needed for more lubricant circulations under exacting conditions, particularly, under operations immediately following start-up.

SUMMARY OF THE INVENTION

It is an object of the present invention to provide a lateral rotary compressor which can eliminate an additional mechanism, e.g., check valves and can thus simplify the structure of the entire arrangement inexpensively and can obtain sufficient amount of lubricating oil supply.

According to one aspect of the lateral rotary compressor of the present invention, there is provided a casing having a lubricating oil reservoir for storing lubricating oil at the lower part thereof, a rotary shaft substantially horizontally extending in the casing, bearing means for rotatably journaling the rotary shaft, an electrically driving element provided at one side end of the rotary shaft, a compressing mechanism provided at the other side of the rotary shaft, and a blade chamber for filling the lubricating oil, a blade contained in the blade chamber and reciprocatingly movably between the first position where the blade chamber is increased to the maximum volume and the second position where the blade chamber is decreased to the minimum volume, and driving power transmitting means for reciprocating the blade by the rotation of the rotary shaft, and a supply tube for communicating the blade chamber with the bearing means and having an opening formed at the position located in the lubricating oil reservoir, said blade chamber being not communicated with the lubricating oil reservoir except via the supply tube, whereby when the blade is moved to the first position, the lubricating oil in the supply tube and the lubricating oil from the reservoir through the opening formed at the supply tube are sucked into the blade chamber, and when the blade is moved to the second position, the lubricating oil in the blade chamber and the lubricating oil from the reservoir through the opening formed at the supply tube are delivered to said bearing means.

The opening of the supply tube is preferably a circular hole having 1.5 to 3.5 mm of diameter.

The distance between the opening of the supply tube and the side to which the blade chamber approaches (the inner wall surface of the extension of sub bearing in the preferred embodiment) is preferably 7.5 to 11.5 mm.

DETAILED DESCRIPTION OF THE PREFERRED EMBODIMENTS

The preferred embodiment of the lateral rotary compressor according to the present invention will now be described in more detail with reference to the accompanying drawings.

Figure 1:
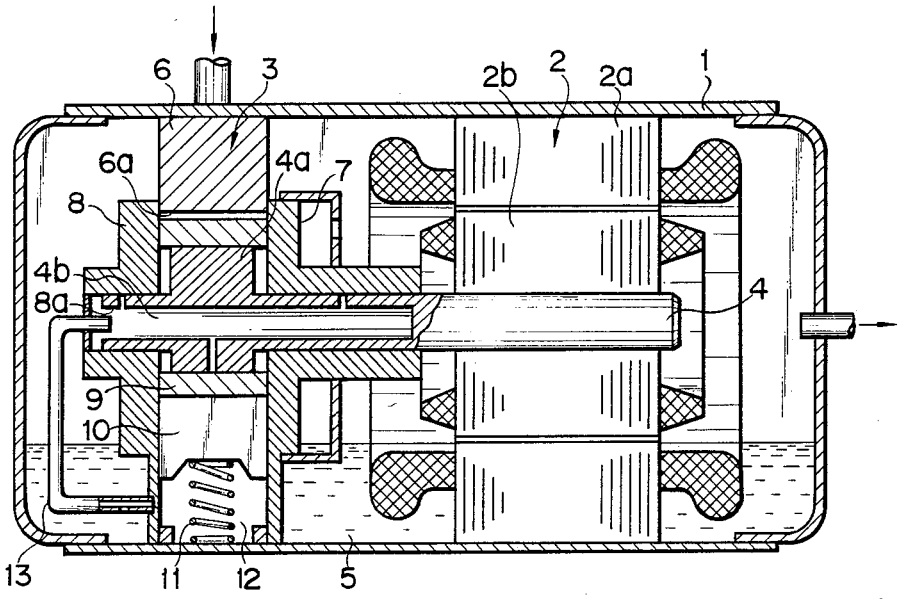
FIG. 1 is a sectional view of a lateral rotary compressor according to one preferred embodiment of the present invention.

As shown in FIG. 1, a rotary shaft 4 is substantially coaxially provided with a cylindrical casing 1 placed horizontally, an electrically driving element 2 is provided at the right side of the rotary shaft 4, and a compressor 3 is provided at the left side of the rotary shaft 4 in the casing 1. Lubricating oil 5 is stored in a lubricating oil reservoir located at the lower portion of the casing 1. The electrically driving element 2 is formed of an ordinary known construction having an annular stator 2*a* secured to the inner wall of the casing 1 and a rotor 2*b* secured to the rotary shaft 4 coaxially with the stator 2*a* and located internally of the stator 2*a*.

The compressor 3 has a cylinder 6 coaxially secured to the inner wall of the casing 1, and main and sub bearings 7 and 8 rotatably journaling the rotary shaft 4 in contact at the inner surfaces with both the end faces of the cylinder 6. A recess is formed at the lower part of the cylinder 6, and a blade chamber 12 is formed by closing the inner end faces of the bearings 7 and 8 from both sides at the recess. An eccentric part 4*a* of large diameter is formed at the part where the rotary shaft 4 is disposed in the hollow part 6*a* of the cylinder 6. The eccentric part 4*a* is so inserted into a cylindrical roller 9 that the peripheral surface thereof is slidably contacted with the inner periphery of the roller. A blade 10 is provided slidably along the radial direction of the cylinder 6 in the blade chamber 12. A compression coil spring 11 which is secured at one end thereof to the inner wall of the casing 1 and is contacted at the other end thereof with the outside of the blade 10 is so provided in the blade chamber 12 for imparting energizing force always to the blade 10 toward the bearings. Thus, the blade 10 is contacted at the inside thereof with the outer peripheral side of the roller 9 always by the spring 11. In such a compressor 3, the blade 10 is reciprocated radially of the cylinder 6 within the blade chamber 12 upon rotation of the rotary shaft 4 by the cooperation of the eccentric rotation of the eccentric part 4*a* of the rotary shaft 4 and the compressing force of the compression spring 11.

Figure 2:
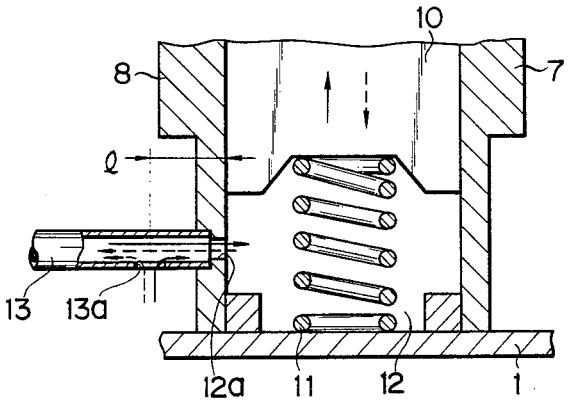
FIG. 2 is a sectional view showing partly expanded compressor in FIG. 1 for explaining the operation of the compressor.

A single through hole 12*a* is formed, as shown in FIG. 2, at the extension of the sub bearing 8 for defining the left end side of the blade chamber 12. Means for communicating with the lubricating oil reservoir, e.g., a through hole or the like is not formed at all at the extension of the main bearing 7 for defining the right end side of the blade chamber 12. A supply tube 13 having an outer diameter of 4.76 mm and an inner diameter of 3.3 mm is inserted at one end thereof into the hole 12*a*. The supply tube 13 is loosely inserted into an axial hole 4*b* formed in the left end face of the rotary shaft 14 at the other end thereof. The hole 4*b* has a branch tube or a radial hole for distributing the lubricating oil fed through the supply tube 13 to between the rotary shaft 4 and the sub bearing 8, between the rotary shaft 4 and the roller 9, as well as between the rotary shaft 4 and the main bearing 7, respectively. An opening 13*a* is formed at the part in the vicinity of the hole 12*a* and disposed in the lubricating oil in the reservoir at the supply tube 13. The opening 13*a* has, for example, a diameter of 2.5 mm in a circular shape, and is formed at the position isolated by l=7.5 mm from the inner end face of the hole 12*a*.

The operation of the compressor thus constructed will now be described.

When the electrically driving element 2 is energized, the rotor 2*b* is rotated via the rotary shaft 4. The roller 9 is eccentrically rotated via the eccentric part 4*a* and the blade 10 is reciprocatingly slidably moved in a stroke of 5.2 mm within the blade chamber 12 by the rotation of the rotary shaft 4. When the blade 10 is so moved in a direction as to increase the volume of the blade chamber 12 (in a direction designated by solid lines indicated by the arrow in FIG. 2), part of the lubricating oil in the supply tube 13 and the lubricating oil of the reservoir of the casing 1 are sucked through the opening 13*a* from the hole 12*a* into the blade chamber 12 as shown by the solid lines in FIG. 2. When the blade 10 is so moved in a direction as to decrease the volume of the blade chamber 12 (in a direction designated by broken lines indicated by the arrow in FIG. 2), the lubricating oil in the blade chamber 12 is exhausted from the hole 12*a* into the supply tube 13, through the supply tube 13 into the hole 4*b* of the rotary shaft 4 and hence to the respective bearings as designated by broken lines in FIG. 2. At this time, an ejector action (sucking action) occurs at the opening 13*a* by the lubricating oil flowing at high speed in the supply tube 13, the lubricating oil in the reservoir is thus passed through the opening 13*a* into the supply tube 13, and is fed into the hole 4*b* together with the lubricating oil exhausted from the blade chamber 12. When the blade 10 is again moved in the direction to increase the volume of the blade chamber 12, part of the lubricating oil exhausted from the blade chamber 12 and retained in the supply tube 13 is again sucked into the blade chamber 12, through the opening 12*a*, and the lubricating oil in the reservoir of the casing 1 is also sucked into the blade chamber 12. Accordingly, the lubricating oil can be supplied to the bearings efficiently without any complicated check valve mechanism. Thus, the cost of the compressor can be reduced, and the number of the components can also be decreased, thereby improving the reliability and the durability of the compressor.

The oil supply amount of the lubricating oil to the bearings depends variably upon the distance l from the inner wall of the extension of the sub bearing for defining the blade chamber 12 to the center of the opening 13*a* of the supply tube 13 and the diameter of the opening 13*a*.

Figure 3:
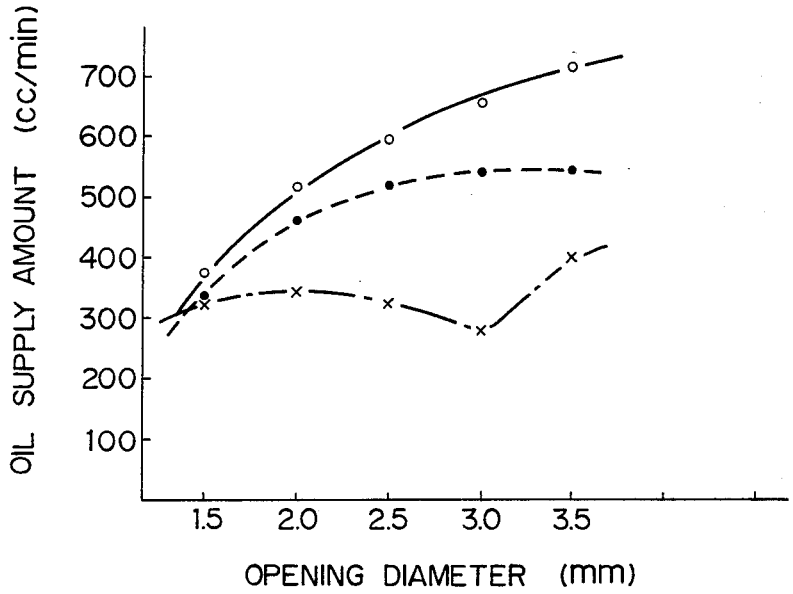
FIG. 3 is a graph experimentally showing the variation of supply of lubricating oil from the opening of the supply tube when the diameter of the opening is varied.

FIG. 3 shows the oil supply amount in case of l=7.5 mm when the compressor rotates at 3,600 r.p.m. and the diameter of the opening 13*a* is varied. In the graph shown in FIG. 3, the ordinate axis represents the oil supply amount (cc/min.), and the abscissa axis represents the diameter of the opening (mm), wherein the solid lines illustrate in case of stable operating time (its viscosity: 6 cst.), the one-dotted chain lines illustrate in case of starting time (viscosity: 68 cst.), and the broken lines illustrate the intermediate time between the stably operating time and the starting time (viscosity: 15 cst.).

Figure 4:
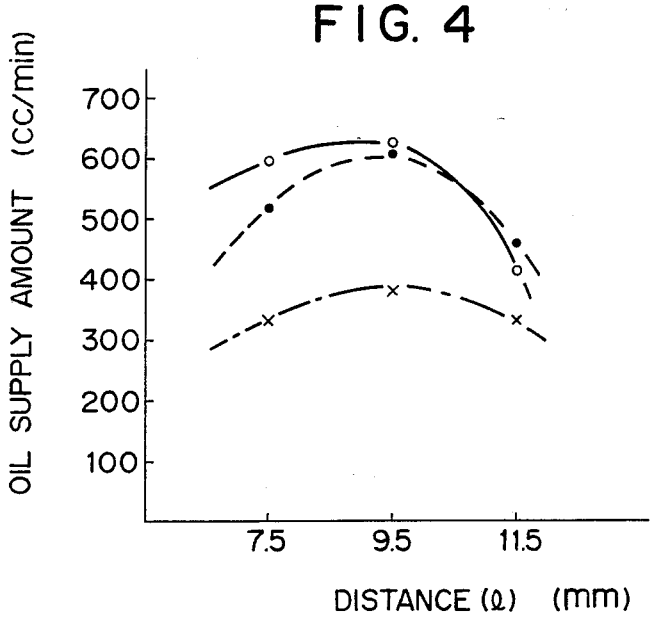
FIG. 4 is a graph experimentally showing the variation of the supply of the lubricating oil when the position from the blade chamber of the opening of the supply tube is varied.

FIG. 4 shows the oil supply amount in case of 2.5 mm of the opening when the distance l is varied and in this particular instance, the maximum oil supply can be obtained approximately at l=9.5 mm.

In this manner, the distance l and the diameter of the opening is controlled, and the oil supply amount can be thus readily set at prescribed value.

Figure 5:
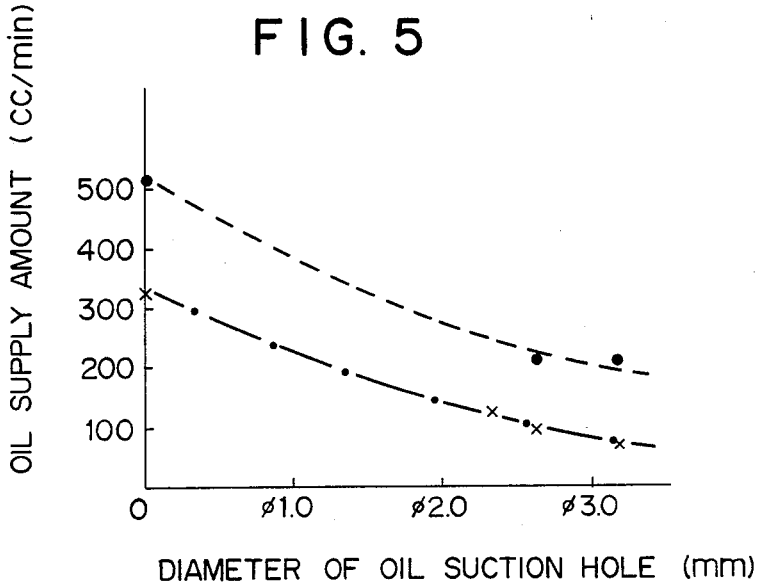
FIG. 5 is a graph showing the variation of supply of lubricating oil in the case of the embodiment and the prior art.

FIG. 5 shows an oil supply pump characteristic curves in the cases where an oil suction hole is provided at a location directly opposite to the end of the oil supply tube of the blade chamber and such opening is not provided there. In FIG. 5 the ordinate shows an amount of oil (cc/min.) supplied and the abscissa the diameter of the oil suction hole, and the distance l is 7.5 mm and the opening formed in the supply pipe is 2.5 mm. As evident from the characteristic curves in FIG. 5, in the compressor with no such oil suction hole (0 mm in FIG. 5) it is possible to obtain 2.5 to 3.0 times as much oil supply as, for example, in the compressor with the oil suction hole of 3 mm. It is desired that the amount of oil supplied be made greater at the starting time of the compressor. In the starting time (viscosity: 68 cst.) it is possible to obtain a greater amount of oil supply in comparison with the compressor with such opening.

In the compressor of the previous embodiment described above, the other end of the supply tube is communicated with the axial hole of the rotary shaft to supply the lubricating oil to the bearings, but may be connected directly to the bearings. The one end of the supply tube is not connected directly at the through hole, but may be provided with a slight interval at the outlet end side of the through hole.

What is claimed is:

1. A lateral rotary compressor comprising:

a casing having a lubricating oil reservoir for storing lubricating oil;

a rotary shaft disposed substantially horizontally in the casing;

bearing means for rotatably journaling the rotary shaft to the casing;

driving means provided at one end of the rotary shaft for rotating said shaft;

a compressing mechanism provided at the other end of the rotary shaft, said mechanism including a blade chamber, a blade disposed in the blade chamber and reciprocally moveable between at least a first position whereat the blade chamber volume is increased to a maximum volume and a second position whereat the blade chamber volume is decreased to a minimum volume, and driving power transmitting means for reciprocally moving the blade in response to the rotation of the rotary shaft; and a supply tube having first and second ends, said first end of said tube communicating with said blade chamber, said second end of said tube communicating with said bearing means, the supply tube including means for defning an opening formed in a portion of said tube disposed within the lubricating oil reservoir, said opening having a diameter in the range of 1.5 mm to 3.5 mm, said blade chamber not communicating with the lubricating oil reservoir except via the supply tube, whereby as the blade is moved from the second position to the first position, the lubricating oil in the supply tube and the lubricating oil in the reservoir in proximity with the opening formed in the supply tube are sucked into the blade chamber, and as the blade is moved from the first position to the second position, the lubricating oil in the blade chamber and the lubricating oil in the reservoir in proximity with the opening formed in the supply tube are delivered to said bearing means.

2. The lateral rotary compressor according to claim 1, wherein the opening of said supply tube is a circular hole.

3. The lateral rotary compressor according to claim 1 or 2, wherein the distance between the opening of the supply tube and an interior surface of the blade chamber adjacent to said first end of said supply tube is within the range of 7.5 mm to 11.5 mm.

4. The lateral rotary compressor according to claim 1, wherein said driving power transmitting means comprises an eccentric part formed at the other end of the rotary shaft, a hollow roller in which the eccentric part is inserted and eccentrically rotating together with the eccentric motion of the eccentric part, and a spring for urging the blade toward the roller so that one end of the blade contacts the roller.

5. The lateral rotary compressor according to claim 4, which further includes a cylinder secured to the inner wall of said casing and formed with a recess in the outer peripheral surface, the blade chamber formed by the recess.

6. The lateral rotary compressor according to claim 5, wherein said bearing means comprise sub and main bearings spaced at a predetermined interval from one another and having inner end faces confronting one another and contacted with both end faces of the eccentric part.

7. The lateral rotary compressor according to claim 6, wherein said sub and main bearings comprise extensions for defining said blade chamber.

8. The lateral rotary compressor according to claim 6, wherein said rotary shaft includes:

means for defining an axial hole, said second end of the supply tube being inserted in said hole, and means for defining a radial hole communicating the sub and main bearings with said axial hole through said rotary shaft.

* * * * *